US005846398A

United States Patent [19]

Carpio

[11] Patent Number: 5,846,398

[45] Date of Patent: Dec. 8, 1998

[54] CMP SLURRY MEASUREMENT AND CONTROL TECHNIQUE

[75] Inventor: Ronald A. Carpio, Austin, Tex.

[73] Assignee: Sematech, Inc., Austin, Tex.

[21] Appl. No.: 697,409

[22] Filed: Aug. 23, 1996

[51] Int. Cl.[6] ..... G01N 27/26; H01L 21/66

[52] U.S. Cl. ..... 205/775; 156/345 LC; 156/345 LP; 156/627.1; 156/636.1; 156/637.1; 156/645.1; 204/400; 204/412; 204/434; 205/789.5; 205/790.5; 205/794.5; 216/86; 216/89; 216/90

[58] Field of Search ..... 156/345 LP, 345 LC, 156/626.1, 627.1, 636.1, 637.1, 645.1, 656.1; 216/84.86, 89.9; 204/400, 412, 434, 420; 205/775, 790.5, 789, 789.5

[56] References Cited

U.S. PATENT DOCUMENTS

| | | | |
|---|---|---|---|
| 2,171,546 | 9/1939 | Kapper | 216/102 |
| 2,434,021 | 1/1948 | Thompson et al. | 252/79.1 |
| 2,939,772 | 6/1960 | Newman et al. | 216/102 |
| 3,351,555 | 11/1967 | Byers et al. | 216/106 |
| 3,442,810 | 5/1969 | Elbreder | 252/79.1 |
| 3,464,908 | 9/1969 | Donaldson | 204/420 |
| 3,498,823 | 3/1970 | Jones et al. | 216/106 |
| 3,964,956 | 6/1976 | Snyder | 216/86 |
| 4,022,625 | 5/1977 | Shelton | 51/309 |
| 4,070,193 | 1/1978 | Tucker | 216/106 |
| 4,138,228 | 2/1979 | Hartfelt et al. | 51/295 |
| 4,154,660 | 5/1979 | Micko | 204/420 |
| 4,512,859 | 4/1985 | Inoue | 451/36 X |
| 4,600,469 | 7/1986 | Fusco et al. | 156/636.1 |
| 4,728,552 | 3/1988 | Jensen, Jr. | 451/527 X |
| 4,793,895 | 12/1988 | Kaanta et al. | 156/627.1 |
| 4,944,836 | 7/1990 | Beyer et al. | 156/645 |
| 4,956,313 | 9/1990 | Cote et al. | 216/89 |
| 4,988,369 | 1/1991 | Akay | 51/293 |
| 5,203,883 | 4/1993 | Perry | 451/36 X |
| 5,209,816 | 5/1993 | Yu et al. | 156/636 |
| 5,225,034 | 7/1993 | Yu et al. | 156/636 |
| 5,234,470 | 8/1993 | Lynn et al. | 451/36 X |
| 5,340,370 | 8/1994 | Cadien et al. | 252/79.1 |
| 5,364,510 | 11/1994 | Carpio | 156/627.1 |
| 5,373,047 | 12/1994 | Schnelle | 451/36 X |
| 5,407,526 | 4/1995 | Danielson et al. | 156/636 |
| 5,449,313 | 9/1995 | Kordonsky et al. | 451/36 X |
| 5,472,370 | 12/1995 | Malshe et al. | 451/41 |
| 5,527,423 | 6/1996 | Neville et al. | 252/79.1 |
| 5,533,923 | 7/1996 | Shamouilian | 451/36 X |
| 5,578,362 | 11/1996 | Reinhardt et al. | 428/147 |

FOREIGN PATENT DOCUMENTS 49-045451B 12/1974 Japan .

OTHER PUBLICATIONS

Brusic et al., "Corrosion and protection of thin–line conductors in VLSI structures," *IBM J. Res. Develop.,* 37(2):173–188, Mar., 1993.

Carpio et al., "Initial study on copper CMP slurry chemistries," *Thin Solid Films,* 266:238–244, 1995.

Farkas et al., "Oxidation and Etching of Tungsten in CMP Slurries," *Advanced Metallization for ULSI Applications in 1994,* Proceedings of the Conference held Oct. 4–6, 1994, in Austin, Texas, pp. 25–32.

Fury et al., "Chemical–Mechanical Planarization of Aluminum–Based Alloys for Multilevel Metallization," *MRS Bulletin,* pp. 61–64, Nov. 1995.

(List continued on next page.)

*Primary Examiner*—T. Tung
*Attorney, Agent, or Firm*—Arnold, White & Durkee

[57] ABSTRACT

Chemical mechanical polishing slurry characteristics, such as oxidant concentration and abrasive particle dispersion, are determined using electrochemical measurement techniques, such as chronoamperometry, amperometry, chronopotentiometry, ionic conductivity, or linear sweep potentiometry. Slurry characteristics may be tested and monitored independent of a CMP polishing tool. Slurry characteristics may also be automatically controlled in an on-line chemical mechanical polishing process using electrochemical measurements.

22 Claims, 5 Drawing Sheets

OTHER PUBLICATIONS

O'Mara, "Planarization by Chemical–Mechanical Polishing for Multilevel Metal Inegrated Circuits," Omar & Associates, Palo Alto, California, date unavailable.

Wang et al., "Chemical–Mechanical Polishing of Dual Damascene Aluminum Interconnect Structures," *Semiconductor International,* pp. 117–122, Oct., 1995.

Syromyatnikov et al., "Polymeric Electrolyes for Lithium Chemical Power Sources," *Russian Chemical Reviews,* 64(3):249–257, 1995, month unavailable.

"Electrochemical Series", CRC Handbook of Chemistry and Physics, 63rd ed., pp. D–162–4, 1983 month unavailable.

Croce et al., "Synthesis and Characterization of Highly Conducting Gel Electrolytes", *Electrochimca Acta,* 39(14):2187–2194, 1994, month unavailable.

U.S. Application Ser. No. 08/572,082 (SEMA:052).

U.S. Application Ser. No. 08/572,632 (SEMA:053).

Stern and Geary, "Electrochemical Polarization," *Journal of the Electrochemical Society,* 104(1):56–63, Jan. 1957.

van Zant, "Ammonium Persulfate as a Stripping and Cleaning Oxidant," *Semiconductor International,* pp. 109–111, Apr. 1984.

US Application Ser. No. 08/667,994 (SEMA:067/EGA).

Willard et al, "Instrumental Methods of Analysis", 5th ed., (1974), month unavailable pp. 655–656.

CM P SLURRY MEASUREMENT AND CONTROL TECHNIQUE

BACKGROUND OF THE INVENTION

1. Field of the Invention

This invention relates generally to semiconductor processing and, more specifically to the measurement of characteristics of slurries used in chemical mechanical polishing (CMP) of semiconductor process layers such as metals, including metals such as tungsten, aluminum or copper, and interlayer dielectrics such as BPSG, PSG, or SIOS. In particular, this invention relates to electrochemical measurement of a chemical mechanical polishing slurry to determine slurry characteristics such as oxidant concentration and abrasive dispersion.

2. Description of the Related Art

Metal layers are used for a variety of purposes in the fabrication of integrated circuits. For example, it is well known that metal layers may be used to form interconnective lines, contacts and other conductive features on and above the surface of a semiconductor wafer. Tungsten, aluminum and copper are widely used to form such metal layers. During the fabrication process, removal of a metal layer or portion of a metal layer may be required in order to pattern and form various features. Traditionally, this removal has been accomplished predominantly by wet or dry etching techniques well known in the art.

Recently, there has been a great deal of interest in another technique for removing layers known as chemical mechanical polishing (CMP). CMP is a process in which a polishing pad and slurry are used to remove layers from the upper surface of an in-process semiconductor wafer. Mechanical movement of the pad relative to the semiconductor wafer provides an abrasive force for removing the exposed surface layer of the wafer. Because of the broad surface area covered by a pad in most instances, CMP is often used to planarize a given layer across an entire wafer.

A CMP slurry serves multiple roles; namely, it is the medium in which the abrasive particles is dispersed, and secondly it furnishes the chemical agents which promote the chemical process. In order for optimum results in CMP processing, there must be a synergistic relationship between the chemical and mechanical processes. For example, in prior art CMP slurries for polishing a metal layer, metal oxidizer, and an abrasive agent have been employed. The oxidant reacts with the metal to form a passive oxide layer, which serves to protect the metal from the etchant. During the polishing process, the abrasive agent removes the passive oxide layer from elevated portions of the metal layer, allowing the metal etchant to etch away a portion of the metal layer. Such etching may not be desirable, though, as dishing of the metal layer may result. Once the metal has been etched, the passive oxide layer forms again. Depressed portions of the metal layer surface are not subject to mechanical abrasion, and therefore are not etched away. This process continues until the elevated portions of the metal layer have been etched away, resulting in planarization. To achieve proper planarization, it is desirable that the slurry not etch or corrode the metal in the absence of the abrasive action provided during the CMP process.

Process reproducibility and uniformity of a CMP process requires periodic measurement and stringent control of the polishing slurry composition. Typically, such slurries are formulated just prior to use from an oxidant (e.g. ferric nitrate) and a particulate (e.g. alumina) dispersion. In other cases, a pre-mixed slurry may be provided. In the latter case, it is particularly important that careful process control is maintained over the slurry, since slurry stability may degrade over time. Part of the slurry instability can be attributed to adsorption of an oxidant, such as ferric ions, onto high-surface area alumina particles, resulting in a reduction in oxidant concentration. In addition, oxidant concentration may vary due to mixing errors and uncertainties in the original oxidant concentration used to prepare the slurry. Because oxidant concentration is one of the key parameters which controls the metal removal rate in a CMP process, variances in oxidant concentration may result in significant variations in the removal rates achieved during CMP processes. Further, some oxidants maybe inherently instable.

SUMMARY OF THE INVENTION

In one respect, the present invention concerns a method of monitoring and/or controlling characteristics of a metal or dielectric polishing slurry in a way that may be correlated to polishing performance. Advantageously, the present invention provides a method for determining, monitoring, and/or controlling a number of slurry parameters based on electrochemical measurements of a slurry. Using the method of the present invention, characteristics may be electrochemically measured and/or monitored independent of a CMP polishing tool. Slurry parameters may also be automatically controlled in an on-line polishing process based on these measurements.

The present invention may be capable of measuring, monitoring and/or controlling a variety of types of slurry parameters, including ion concentration and dispersal of abrasive particles. In addition, benefits of the present invention may be realized when used with a variety of slurry types, including those slurries containing abrasives and/or with or without separately added oxidants. This is made possible, in part, because electrochemical measurements of a metal polishing slurry may be affected by, among other things, abrasive particle dispersal, oxidant ion concentration, and/or concentration of other ions present in a slurry. Therefore, the present invention may make it possible to measure, monitor and/or control, among other things, the stability and concentration of oxidants and abrasives within a slurry as a function of time or as a function of polishing process exposure.

As a further advantage, the use of electrodes that are substantially unreactive with a slurry may allow more accurate and consistent measurements to be made of slurry electrochemical characteristics, without interference from reactions between a slurry and an electrode. To increase measurement accuracy and consistency even further, the present invention may be practiced using a third reference electrode.

In another respect, this invention relates to a method of measuring electrochemical characteristics of a chemical mechanical polishing slurry. In this method, a chemical mechanical polishing slurry having a concentration of ions is provided. Also provided is at least one electrode which is made of an electrically conductive material that is substantially unreactive with the slurry. An electrical current is generated between the electrode and the slurry, and the current is measured.

In another respect, this invention relates to a method of measuring electrochemical characteristics of a chemical mechanical polishing slurry. In this method, a chemical mechanical polishing slurry is provided. Also provided is at least one electrode which is made of an electrically conductive material that is substantially unreactive with the slurry. A voltage is applied between the electrode and the slurry to generate an electrochemical response, and the electrochemical response is measured.

In another respect, this invention relates to a method of controlling slurry parameters of a slurry used in a chemical mechanical polishing process. In this method, a chemical mechanical polishing slurry having at least one slurry parameter to be controlled is provided. Also provided is a chronoamperometric sensing means that includes a power supply, a working electrode and a counter electrode that are substantially unreactive with the slurry. In this method, the working electrode and the counter electrode are contacted with the chemical mechanical polishing slurry and an electrical current is generated through the slurry and between the working and counter electrodes. The electrical current is measured, and at least one slurry parameter is controlled based on this measurement.

In another respect, this invention relates to a system for controlling slurry parameters of a chemical mechanical polishing slurry. This system includes a chronoamperometric sensing apparatus that has a power supply, a working electrode and a counter electrode. The working and counter electrodes are substantially unreactive with the slurry, and the sensing apparatus is capable of generating a signal representative of at least one slurry parameter to be controlled when the electrodes are in contact with the slurry flow stream. This system also includes a parameter control device coupled to the slurry flow stream, and an automatic electronic control system coupled to the chronoamperometric sensing means for receiving the slurry parameter signal. The automatic electronic control system is also coupled to the parameter control device for controlling the slurry parameter.

DETAILED DESCRIPTION OF SPECIFIC EMBODIMENTS

Using embodiments of the disclosed method, oxidant concentration, abrasive particle distribution and other characteristics of a metal polishing CMP slurry may be measured using electrochemical techniques. For example electrochemical perturbation techniques may be used such as voltammetry, and more particularly, chronoamperometry. Embodiments of the disclosed method may be relatively fast, simple, reproducible and may be essentially non-destructive and relatively inexpensive to implement.

Figure 1:
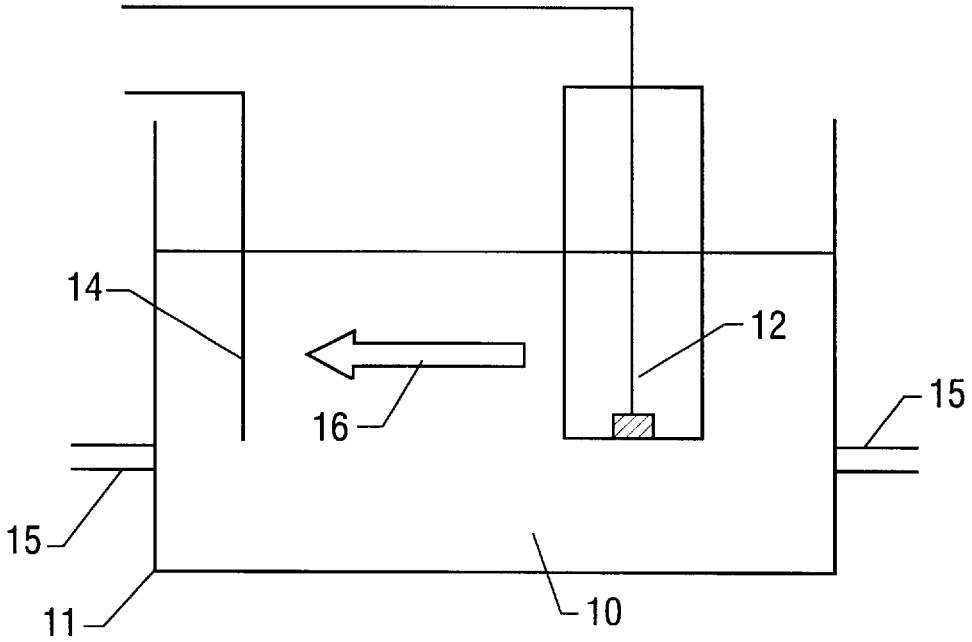
FIG. 1 is a block diagram of a chronoamperometry measurement cell for use with the present invention.
Figure 2:
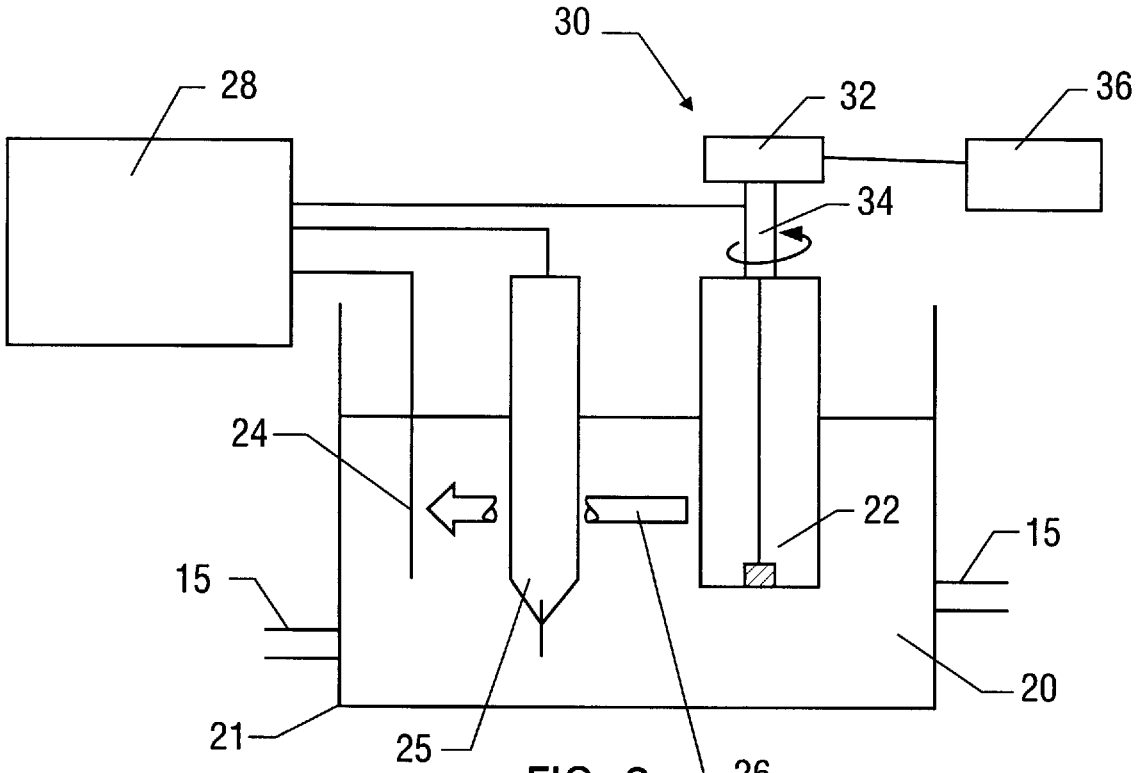
FIG. 2 is a chronoamperometry measurement cell having a reference electrode for use with the present invention.

In embodiments of the disclosed method, oxidant concentration as well as concentration and dispersion characteristics of an abrasive in a CMP slurry may be measured by monitoring the electrochemical characteristics of the slurry. In a typical embodiment of the disclosed method, chronoamperometry is used to make electrochemical measurements. In FIG. 1, a simplified chronoamperometry measurement cell 11 is depicted. Referring to FIG. 1, a voltage pulse is applied between a working electrode 12 and a counter electrode 14, both immersed in a slurry 10 which may contain an oxidant. The resulting current pulse 16 passing between working electrode 12 and counter electrode 14 is measured. Generally it is desirable to utilize a counter electrode with a high surface area. A portion of a counter electrode is shown in FIGS. 1 and 2; however, in implementation it may be desirable to utilize a counter electrode shaped as a coil to provide more surface area for the electrode. Ports 15 may be provided to allow for inlet and outlet flow of the slurry, however, such slurry flow is not necessary. With a suitably applied potential, the measured current 16 is proportional to the oxidant ionic concentration. The potential utilized should cause a reduction reaction, which typically is a potential slightly negative of the open circuit potential (i.e., the cathodic potential); however, not to a negative level that would cause a reduction of the slurry solvent.

FIG. 2 is a simplified illustration of a chronoamperometry device used in the practice of one embodiment of the disclosed method. In FIG. 2, a CMP slurry 20 suitable for polishing metal layers, such as those comprising tungsten, aluminum or copper is contained within a measuring cell 21. In FIG. 2, CMP slurry 20 may comprises at least one oxidant capable of forming a passive oxide film on a metal layer, for example a ferric nitrate oxidant comprising ferric ($Fe^{+3}$) ions. Such a slurry is typically used for polishing metal layers comprising tungsten. However, it will be understood with benefit of the present disclosure that the embodiment of FIG. 2 may also be applied to measure characteristics of CMP slurries for polishing other metal layers, such as aluminum or copper, and containing other oxidants, for example, ammonium peroxydisulfate, alkali or metal peroxydisulfate salts, iodates, bromates, or chlorates. The slurry of FIG. 2 also comprises an abrasive, typically alumina such as γ-alumina or fumed alumina. However, any other type of abrasive used in CMP processing may be employed in the practice of the disclosed method including, but not limited to, magnesia, polymers, and silica. When used to measure slurry characteristics of a CMP slurry containing ferric nitrate, the embodiment of FIG. 2 may not only be employed to measure the ferric ($Fe^{+3}$) ion concentration, but also the ferrous ($Fe^{+2}$) ion concentration. If present, the ferrous ($Fe^{+2}$) ion concentration typically exists at a lower concentration than the ferric ion concentration and may be monitored with a positive potential pulse (i.e., the anodic potential). The slurry may be provided as a slurry flow through inlet and outlet ports 15; however, slurry flow is not required.

In the embodiment of FIG. 2, ferric ions are reduced according to the equation $Fe^{+3}+e^{-}\rightarrow Fe^{+2}$ by potential pulse chronoamperometry in which reduction is forced to occur at a working electrode by the application of a short duration potential of appropriate magnitude. The resulting current may be measured and integrated over time. In the embodiment of FIG. 2, a platinum working electrode 22 and a platinum counter electrode 24 are typically employed, although other suitable electrode compositions, such as for example, gold, rhodium, glassy carbon, or graphite may also be employed. It is desirable that the working electrode be formed of a material that is substantially unreactive to the slurry so that reaction of the electrode with the slurry will not add a component of error to the measurements. Thus, the electrode will not have a passivation layer formed upon it that would inhibit electron transfer. In addition, an Ag/AgCl reference electrode 25 may be provided to obtain voltage potential readings. The use of a reference electrode provides an electrode at which no reaction is occurring so that the potential between the working electrode 22 and the reference electrode may be obtained without effect of the any reactions. Other suitable reference electrode materials include saturated calomel, mercury/mercurous sulfate, or hydrogen, for example.

In operation of the embodiment of FIG. 2, a voltage pulse is applied between working electrode 22 and counter electrode 24 and the resulting current pulse 26 passing between the electrodes is measured for purposes of determining ferric or ferrous ion concentration. Reference electrode 25 is used to monitor the voltage potential. A potentiostat 28 is typically employed to accurately control the applied voltage potential and to monitor the current levels in the cell. For example, a suitable potentiostat is the EGG Electrochemical Impedance Analyzer 6310 available from EGG Princeton Applied Research. In the alternative, a galvanostat or other suitable power supply may also be employed. In practice, current 26 is typically measured versus time and integrated in order to generate a calibration curve of charge versus ionic concentration. However, it will be understood with the benefit of this disclosure that the current at a given point in time during a pulse cycle could also be used to generate a calibration curve. In the case of a slurry containing a ferric nitrate oxidant, a separate calibration curve is typically generated for ferric and ferrous ion concentrations.

In order to maintain dispersion and prevent settling of the slurry particles, it is typically desirable to stir or otherwise ensure agitation of a slurry during chronoamperometric measurement. As shown in FIG. 2, this may be accomplished using a rotating working electrode assembly 30 which includes a motor 32, a shaft 34, and a working electrode 22. Such assemblies are commercially available, such as for example, from Pine Instrument Co. Electrodes may also be obtained from EGG Princeton Applied Research. Motor 32 of the rotating electrode assembly 30 may be optionally controlled by a controller 36. Although the embodiment of FIG. 2 includes a rotating working electrode for stirring a slurry, it will be understood with benefit of this disclosure that suitable results may be achieved with a rotating counter electrode and/or rotating reference electrode as well. It will also be understood with benefit of this disclosure that a separate stirring or agitation mechanism may also be employed. In operation, working electrode 22 of the embodiment of FIG. 2 is rotated during the slurry measurement process. This rotation serves to keep slurry particles dispersed and also increases mass transport of species being oxidized or reduced during the measurement process. This increases the current 26 measured during the voltage application step, thereby increasing the sensitivity of the measurement technique. Rotation of electrodes and slurry flow is not required however, and in some cases may not be desired. For example, if the effects of settling within a slurry are desired to be monitored, rotation may be undesirable for some tests.

Figure 3:
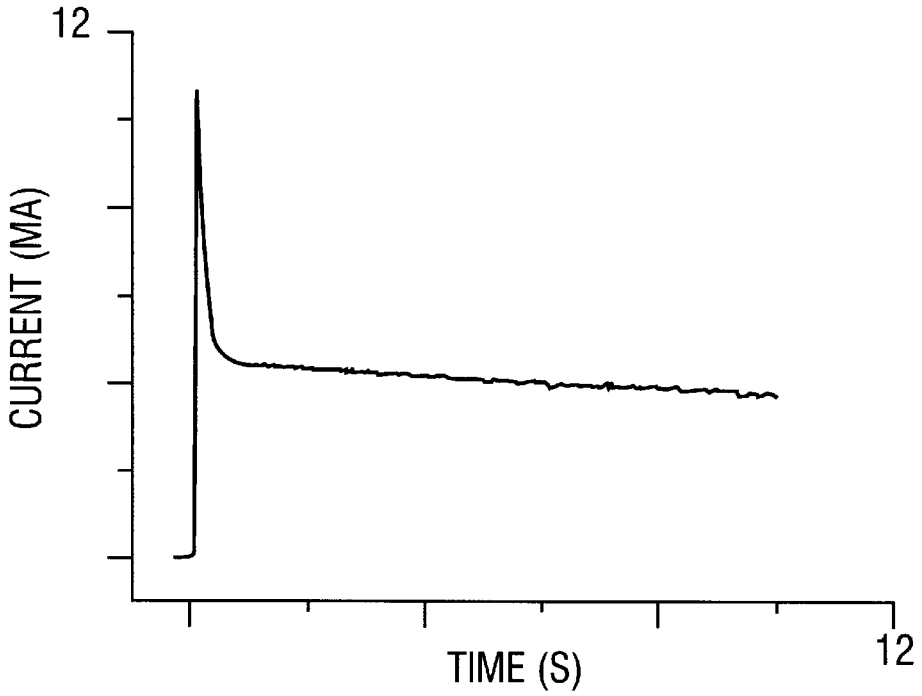
FIG. 3 is a chronoamperogram of a CMP slurry containing an oxidant.

FIG. 3 illustrates a typical chronoamperogram obtained from the measurement of an oxidant-containing CMP slurry using the embodiment illustrated in FIG. 2. In FIG. 3, current (in milliamperes) is measured versus time (in seconds). The area under the resulting curve is integrated to obtain charge (in millicoulombs). Changes detected in the charge may be utilized to note when characteristics of a slurry have changed. Alternatively, a comparison of just a specific time on the time vs. current curve to the same time during another measurement cycle conducted at some later date may also indicate a change in the slurry conditions. Further, changes in slurry conditions may also be detected by comparing the current values at multiple time points in a first measurement cycle to the same time points in another measurement cycle conducted at some later time.

Figure 4:
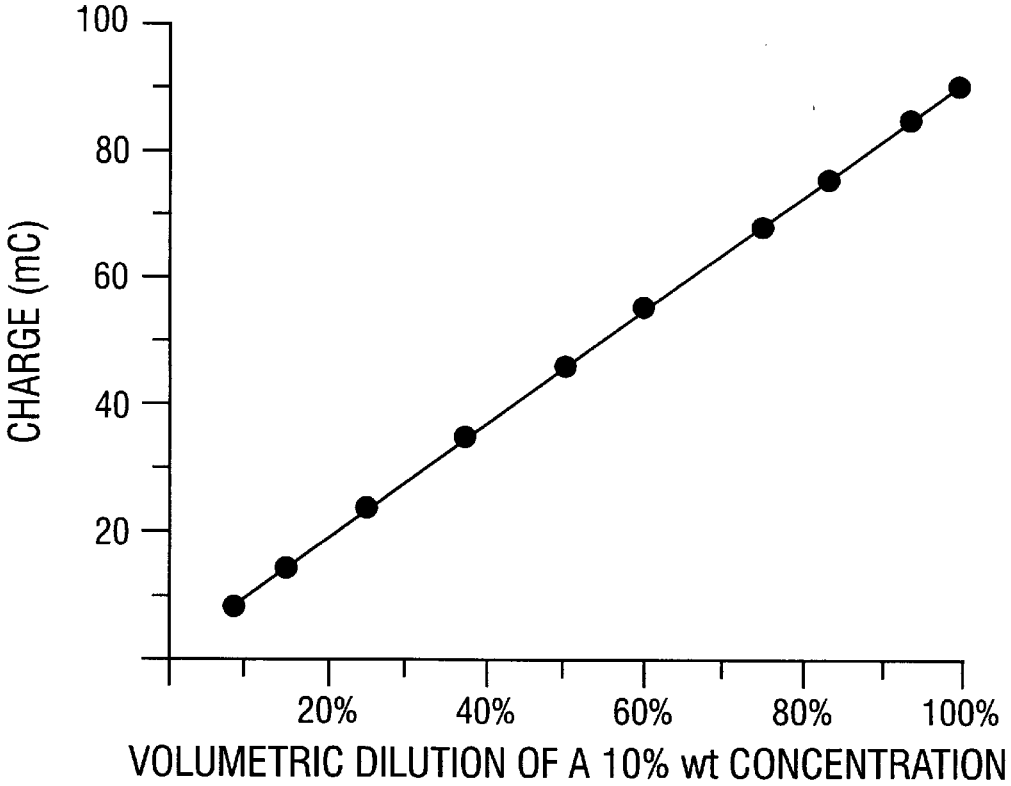
FIG. 4 is a graph of ferric nitrate oxidant concentration versus charge.

FIG. 4 represents a typical ferric nitrate oxidant calibration curve of charge versus ferric ion concentration obtained from the integration of a series of chronoamperograms as presented in FIG. 3. A calibration curve such as that illustrated in FIG. 4 may be obtained by making multiple measurements of current or charge at varying ferric nitrate concentrations in a CMP slurry using a chronoamperometric device such as that illustrated in FIG. 2. The calibration curve may then be utilized to determine unknown ferric nitrate oxidant concentrations in other CMP slurries. In FIG. 4, the sensitivity of the chronoamperometric sensor of the disclosed method and apparatus is illustrated by the resolution of the charge measurements made of a 10% wt. oxidant concentration volumetrically diluted over a range to 0.1 of its original concentration.

Figure 5:
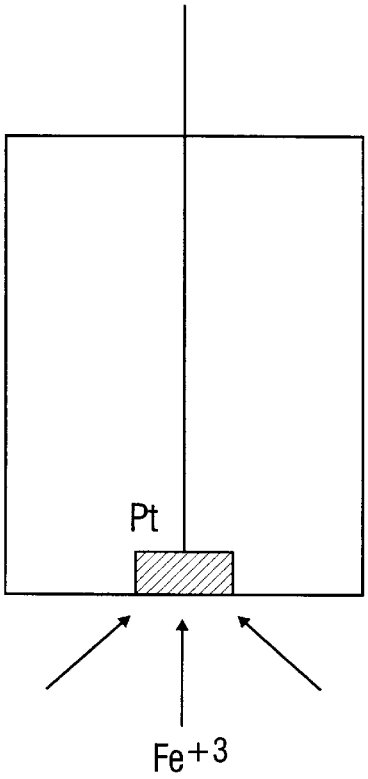
FIG. 5 and FIG. 6 illustrate a working electrode immersed in slurries without an abrasive and with an abrasive, respectively.
Figure 6:
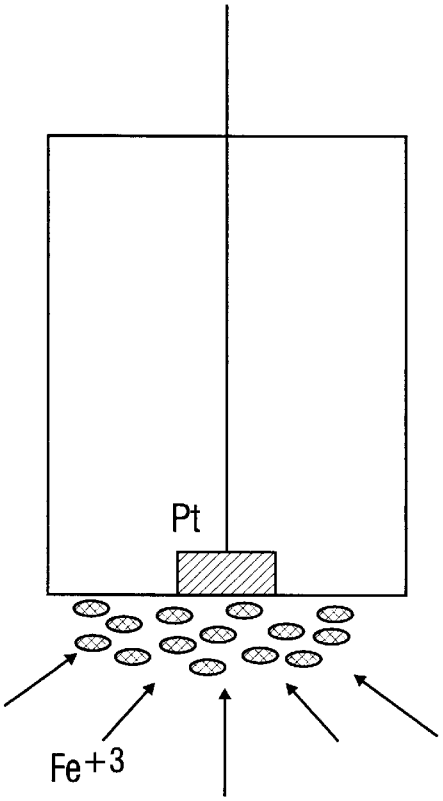

A further advantage of the disclosed method and apparatus is sensitivity to the concentration and dispersion characteristics of an abrasive in a CMP slurry. Although abrasive solids are typically non-conducting, these particles are dispersed in the conducting liquid phase of a CMP slurry and modify the ionic conductivity of the slurry. Referring to FIGS. 5 and 6, reduction in the mass transport of oxidant ions by abrasive slurry particles is illustrated for a slurry containing a ferric nitrate oxidant. In FIG. 5, a platinum working electrode 42 is shown immersed in an aqueous solution of ferric nitrate 40 containing no abrasive slurry particles. When a negative voltage potential is applied to working electrode 42, ferric ($Fe^{+3}$) ions migrate unimpeded through the aqueous solution to the electrode as shown. FIG. 6 shows the platinum working electrode 42 immersed in an aqueous ferric nitrate solution 44 containing abrasive slurry particles 46. In a manner similar to FIG. 5, when a negative voltage is impressed upon working electrode 42 ferric ions are attracted toward the electrode. However, in contrast to FIG. 5, the movement of the ferric ions in FIG. 6 is inhibited or partially blocked by abrasive slurry particles 46. A reduction in the mass transport of oxidant ionic particles toward the working electrode will result in decreased current between working electrode 22 and counter electrode 24 of the embodiment of FIG. 2. Consequently, in those situations where oxidant ionic concentration is stable, the disclosed method and apparatus may be used to monitor the degree of dispersion of an abrasive in a CMP slurry. In other cases the disclosed method and apparatus may be used to monitor the oxidant ionic concentration, the quality of the abrasive particle dispersion in the CMP slurry, and/or the build-up of reaction by-products.

Although the embodiment illustrated in FIG. 2 employs chronoamperometry for slurry oxidant measurement, other suitable electrochemical measurement techniques may be employed in the practice of the disclosed method. For example, amperometry, using the application of a constant voltage rather than a pulse, may be employed. Chronopotentiometry may also be utilized in the practice of the disclosed method. In this technique a current pulse is applied with a galvanostat and the voltage response is measured. Chronopotentiometry offers the advantage that a voltage (iR) drop due to solution resistance can be easily measured. In addition, because chronopotentiometry uses a constant current, the charge transferred is easily determined by multiplication of the constant current value by the application time. Finally, ionic conductivity measurements (using AC or DC methods) may be employed in the practice of the disclosed method and apparatus. Although ionic conductivity may not be as specific or as sensitive as the chronoamperometric embodiment, the concentration of ionic species, as well as the abrasive particle concentration and dispersion profiles in a CMP slurry may be monitored using this technique. Linear sweep potentiometry which utilizes a ramp change in potential while current is monitored may also be utilized. Electrochemical techniques such as these may be found in J. Plambeck "Electroanalytical Chemistry Basic Principles And Applications," John Wiley & Sons, N.Y. (1982) and B. H. Vassos and G. W. Ewing "Electroanalytical Chemistry," John Wiley & Sons, N.Y. (1983), the disclosures of which are expressly incorporated herein by reference.

In another embodiment of the disclosed method and apparatus, slurry oxidant and abrasive particle characteristics may be monitored and controlled in an on-line process monitoring and control configuration. In situ chronoamperometric measurements may be used to monitor the relative oxidation effectiveness of a CMP slurry during use, and this measurement may in turn be used to control oxidation effectiveness by, for example, the addition of materials, such as oxidant. An electrochemical chronoamperometric measurement cell similar to that illustrated in FIG. 2 may be employed. The measurement cell would generally be placed in series with the CMP slurry flow so that the electrodes in the cell are constantly exposed to a circulating CMP slurry which would enter and exit the cell through the ports 15. It will be understood with the benefit of this disclosure that a rotating electrode may not be used where process flow conditions provide the desirable hydrodynamic conditions for chronoamperometric measurement. The measurement cell may be placed at any suitable location in the CMP process flow stream, including a feed line of a CMP tool, a slurry storage tank associated with a tool, the slurry outlet line of a CMP tool, etc.

Because the CMP process flow generates flow through the measurement cell, rotation of the working electrode may not be necessary if fluid flow within the cell is desired. An automatic electronic controller may also be provided for analyzing the current generated between the working electrode and counter electrode. The data obtained from the electronic controller may be used to provide feedback control of the CMP process. For example, oxidant levels may be controlled by addition of oxidant based on a stored calibration curve stored in the controller's memory to maintain an oxidant concentration set point. Similarly, the mixing of the slurry may or other CMP process control variables may be altered based upon data obtained relating to the abrasive characteristics measured. In addition to the embodiment illustrated in FIG. 2, further chronoamperometric configurations suitable for measuring a CMP slurry oxidant concentration may also be employed, for example a three electrode miniature sensor may be incorporated into a mixing chamber which contains a CMP slurry at the point of use, or elsewhere in a CMP process.

Thus, the techniques described above may be utilized to monitor CMP slurry conditions, in particular the conditions of the slurry itself. Measurements which reflect multiple variables, such as the oxidant concentration and the abrasive particle distribution, may be obtained. Alternatively, the measurements may reflect conditions related to only one process variable. For example, if the oxidant concentration of a slurry is relatively stable, than changes in the chronoamperometry measurements may be attributed to particle distribution changes. Alternatively, it may be possible to remove oxidants or particles so that the remaining variable may be measured. For example, one may utilize a filtration system to remove the abrasive. An example filtration technique may utilize the Miniram and Luram apparatus available from Creative Scientific Equipment, Long Beach, Calif.

The abrasive particles which are added to the slurry for CMP are typically oxides such as silica, alumina, ceria, etc. The particle size and particle dispersion play an important role in polishing uniformity. Unless properly dispersed, these particles tend to agglomerate and settle out. Many methods of simple agitation will not prove to be effective in separating these particles from agglomerates. Thus, a method which is able to monitor the effectiveness of the dispersion process can be of great value. Such a sensor capability can be used to control the dispersion process to insure that it is effective and/or reproducible.

The particles themselves are nonconducting and electrochemically inactive but they do affect the electrochemical properties of the slurry which can be exploited to advantage. In the case of slurries which are used for metal polishing, an oxidant is present. It is shown in the figures in this disclosure that the measured electrochemical (in this case chronoamperometric) response is modified by the presence of slurry particles and the degree of dispersion of these particles. The more effective the dispersion and the larger the concentration of the particles, the lower the reduction current. As the particles agglomerate, the reduction current increases due to improved mass transport of the ferric ions to the working electrode.

If the dispersion is improved by rapid stirring using the rotating working electrode for this purpose, and then the rotation of the electrode is terminated, the particles will agglomerate and settle to the bottom of the slurry container. Thus, the degree of settling can be followed. It should be understood that the current will drop initially due to termination of the stirring action. After this initial drop, the decay in current will be due to changes in the dispersion of the particles.

In slurries used for oxide polishing there is no need for an oxidant, since the Si is already oxidized. Such slurries are basic aqueous solutions and contain, generally, silica particles. The slurries are made basic by the addition of ammonium hydroxide or KOH, generally. Thus, the concentration of the base and the particulate properties are of chief importance. Again, electrochemical methods can be utilized for this purpose. The main electrochemical property of the slurry to be measured is the ionic conductivity. This parameter can be measured by AC impedance of DC pulse methods. The ionic conductivity will be determined both the concentration of the basic additive as well as by the particulate concentration and degree of dispersion.

It is clear that the value of the measured electrochemical parameter is controlled by the chemical additive and the abrasive particles. In some cases, there is a need to determine the individual contributions. The combined response can be measured and then the separate response of the slurry minus the abrasive particles can be measured subsequently to determine the concentration of the chemical additive. To do so, the slurry particles must be removed by a process such as filtration of an aliquot. A high pressure filtration syringe system such as the Miniram/Luram manufactured by Creative Scientific can be utilized for this purpose.

EXAMPLES

The following examples are illustrative and should not be construed as limiting the scope of the invention or claims thereof.

Example 1

Chronoamperometric Measurement of a Ferric Nitrate CMP Slurry

Using the embodiment illustrated in FIG. 2, chronoamperometric measurements were made on a 10% by weight ferric nitrate CMP slurry solution having alumina abrasive material. In this example, a platinum working electrode rotating at 250 rpm was employed.

An equilibrium potential of 0.47 V between the working electrode and the Ag/AgCl reference electrode was first measured. The potential was then stepped to 0 V in order to measure ferric ion concentration. Finally, the potential was stepped to 0.8 V in order to measure the ferrous ion concentration. In this example, a voltage pulse having a duration of about 5 seconds was used, however, it will be understood that the duration of a voltage pulse may be varied and suitable results still achieved.

Figure 7:
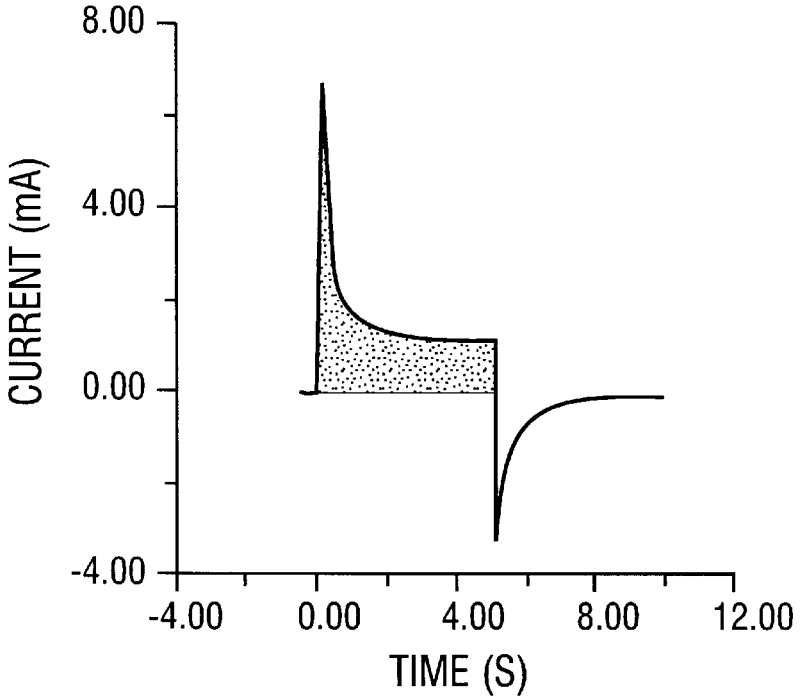
FIG. 7 is a chronoamperogram of a reduction reaction and an oxidation reaction of a ferric nitrate CMP slurry solution.

The resulting chronoamperogram is presented, in the form of current in milliamperes versus time in seconds in FIG. 7. In FIG. 7 it can be seen that a reduction reaction was used to measure the ferric ion concentration, while an oxidation reaction was employed for the ferrous ion concentration measurement.

Example 2

Chronoamperometric Measurement of Reduction in the Slurry Over Time

Chronoamperometric measurements of a 5% by weight ferric nitrate CMP slurry having alumina abrasive material were taken over a period of approximately five months in order to measure changes in the slurry over time. In this example, the embodiment of the disclosed apparatus shown in FIG. 2 was employed without rotating the working electrode. In this example the entire slurry was tested and continuous mixing was employed to keep the particles suspended. Samples were obtained from a slurry on three different dates. Once the cell was loaded with slurry, actual measurements were relatively quick, taking about 10 seconds. The results of these measurements are presented in Table 1 and are given in terms of charge in millicoulombs. The data presented in Table 1 reveals a significant change in the slurry over time. It is believed that this change reflects an agglomeration of the abrasive particles even in the presence of continuous mixing during the testing. While ferric ion concentration is presented in Table 1 in terms of charge, it will be understood that calibration curves may be prepared with which to the convert the millicoulomb readings to reflect ferric ion concentration in terms of any other concentration unit desired.

TABLE 1

CHRONOAMPEROMETRIC MEASUREMENT OF % FERRIC NITRATE SLURRY

| Time Lapse | Ferric Conc. (mC) |
|---|---|
| — | 8.023 |
| Approximately 14 weeks | 11.25 |
| Approximately 15 weeks | 12.03 |

Example 3

Hydrodynamic Dependence of Chronoamperometric Measurements

Figure 8:
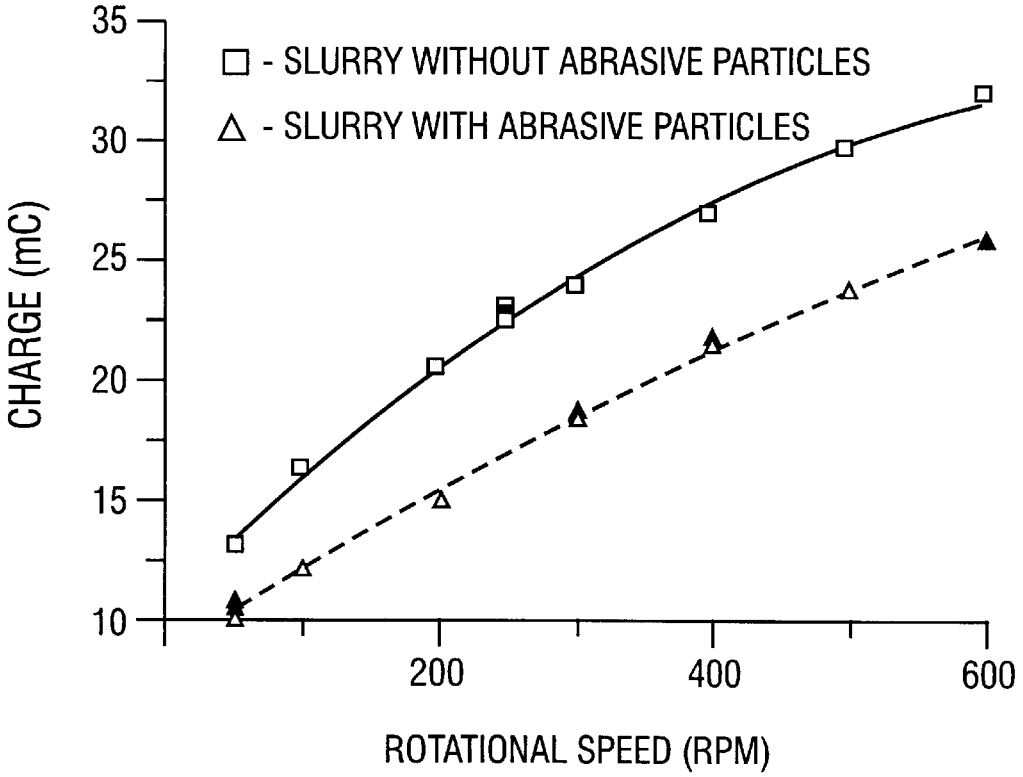
FIG. 8 is a graph of charge versus rotational speed of slurries with and without abrasive particles.

The hydrodynamic dependence of chronoamperometric response as a function of electrode rotational speed was investigated for a 5% by weight ferric nitrate CMP slurry with and without alumina abrasive particles. The embodiment of the disclosed apparatus shown in FIG. 2 was employed for measuring the slurry. FIG. 8 is a plot of charge versus electrode rotational speed. This example shows that increased rotational speed increases mass transport (i.e. current) and that particles suppress the current.

Example 4

Effect of Time on Slurry Particle Distribution

Figure 9:
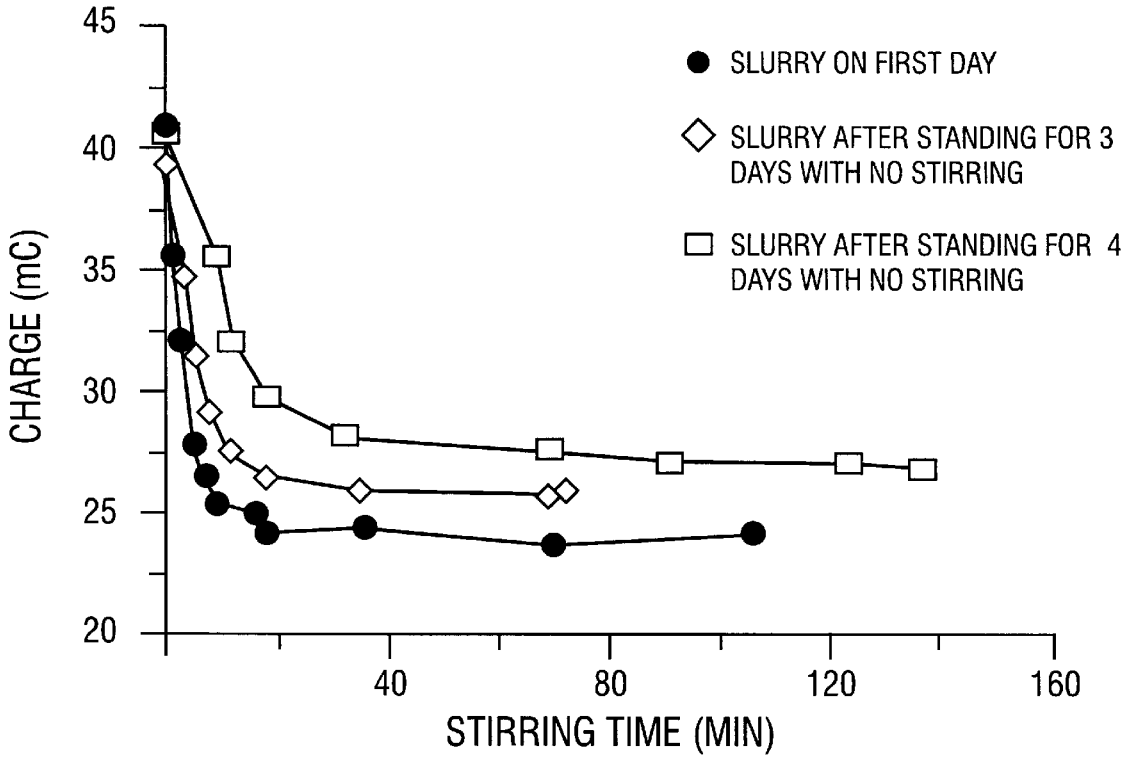
FIG. 9 is a graph of charge versus stirring time of a ferric nitrate CMP slurry.

The stability of a 5% ferric nitrate CMP slurry (alumina abrasive) over time was investigated by taking chronoamperometric measurements of the slurry over a period of four days using the embodiment of the disclosed apparatus shown in FIG. 2. FIG. 9 is a plot of charge versus electrode stirring time for chronoamperometric measurement of the CMP slurry taken at preparation of the slurry (first day), and after three and four days of standing with no stirring between measurements. In this example the electrode stirring rate was 500 rpm. This example shows that the settling of particles will increase the charge detected. This example also demonstrates that particle agglomeration occurs over time if a slurry is allowed to settle, and that agglomerates cannot be completely redisbursed by stirring alone. Alternatively, the techniques of the present invention could also be utilized to monitor the settling of particles over time after a stirring action has been stopped.

Example 5

Effect of Polishing on Slurry Particle Distribution

Figure 10:
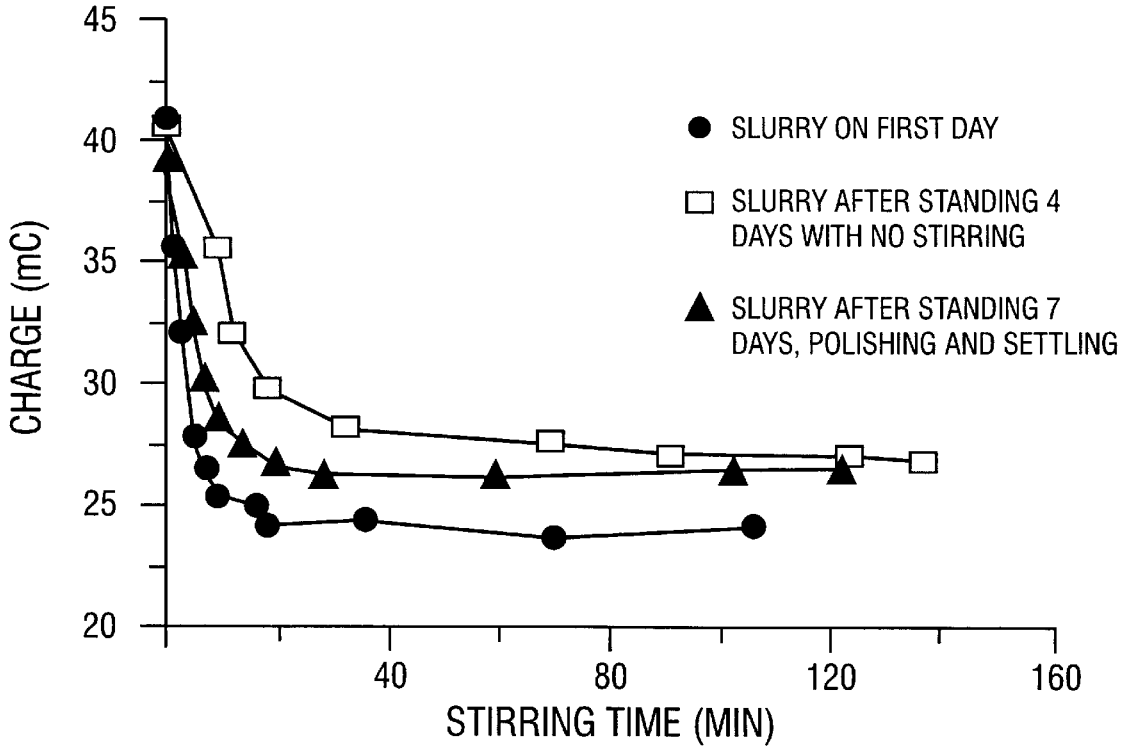
FIG. 10 is a graph of charge versus slurry time demonstrating the effect of slurry particle distribution.

The effect of polishing upon particle distribution measurements was investigated for the slurry of Example 4 using the embodiment of the disclosed apparatus shown in FIG. 2. FIG. 10 is a plot of charge versus electrode stirring time for chronoamperometric measurements of the slurry taken (1) on a first day; (2) after settling for 4 days; (3) after being allowed to settled for 7 day, then subjected to polishing of tungsten and, and finally settling till the 34th day. In this example, polishing was carried out on the seventh day at 250 rpm and 70 psi This example shows that the impact of polishing on the particle distribution may be monitored.

While the invention may be adaptable to various modifications and alternative forms, specific embodiments have been shown by way of example and described herein. However, it should be understood that the invention is not intended to be limited to the particular forms disclosed.

Rather, the invention is to cover all modifications, equivalents, and alternatives falling within the spirit and scope of the invention as defined by the appended claims.

What is claimed is:

1. A method of determining characteristics of a chemical mechanical polishing slurry based on a comparison of a first current value measured as a function of time with a second current value expressed as a function of time, comprising the steps of:

providing a chemical mechanical polishing slurry having a concentration of ions;

providing at least one working electrode comprised of an electrically conductive material that is substantially unreactive with said slurry;

generating an electrical current between said at least one electrode and said slurry;

measuring the first current value of said electrical current as a function of time; and comparing said first value of current measured as a function of time with said second value of current expressed as a function of time to determine said slurry characteristics.

2. The method of claim 1, wherein said ions are oxidizing ions; and wherein said concentration of said oxidant ions is determined based on said step of comparing.

3. The method of claim 2, wherein said slurry is contained within a chemical mechanical polishing system; and further comprising the step of controlling said concentration of oxidant ions in said slurry based on said measurement of said electrical current.

4. The method of claim 1, further comprising the step of providing an electronic controller and wherein said step of comparing is performed by said controller.

5. The method of claim 1, wherein said slurry further comprises abrasive particles dispersed within said slurry; and wherein dispersal of said abrasive particles in said slurry is determined based on said step of comparing.

6. The method of claim 5, wherein said slurry is contained within a chemical mechanical polishing system; and further comprising the step of controlling said dispersal of abrasive particles in said slurry based on said measurement of said electrical current.

7. The method of claim 1, wherein said ions are oxidizing ions; wherein said slurry further comprises abrasive particles dispersed within said slurry; and wherein said step of comparing reflects oxidant ion concentration and abrasive particle distribution.

8. The method of claim 7, wherein said oxidant ion concentration is relatively stable and wherein dispersal of said abrasive particles in said slurry is determined based on said step of comparing.

9. The method of claim 1, wherein said ions are oxidizing ions; wherein said slurry further comprises abrasive particles dispersed within said slurry; and further comprising removing either oxidant ions or abrasive particles prior to measuring said electrical current.

10. A method of determining slurry characteristics and controlling slurry parameters of a slurry contained in a chemical mechanical polishing system, comprising the steps of:

providing a chemical mechanical polishing slurry having at least one slurry parameter to be controlled;

providing at least one working electrode comprised of an electrically conductive material that is substantially unreactive with said slurry;

generating an electrical current between said at least one electrode and said slurry;

measuring said electrical current;

determining said slurry characteristics based on said measurement of said electrical current; and controlling said at least one slurry parameter based on said measurement of said electrical current.

11. A method of controlling slurry parameters of a slurry used in a chemical mechanical polishing process, comprising the steps of:

providing a chemical mechanical polishing slurry having at least one slurry parameter to be controlled;

providing a sensing apparatus, said sensing apparatus comprising a power supply, a working electrode and a counter electrode; said working and counter electrodes being substantially unreactive with said slurry;

contacting said working electrode and said counter electrode with said chemical mechanical polishing slurry;

generating an electrical current through said slurry and between said working and counter electrodes;

measuring said electrical current; and controlling said at least one slurry parameter based on said measurement of said electrical current.

12. The method of claim 11, wherein said slurry further comprises abrasive particles dispersed within said slurry; and wherein said at least one slurry parameter to be controlled is dispersal of said abrasive particles within said slurry.

13. The method of claim 11, wherein said slurry further comprises a concentration of oxidant ions; and wherein said at least one slurry parameter is oxidant ion concentration.

14. A system for controlling slurry parameters of a chemical mechanical polishing slurry having a process flow stream containing at least one slurry parameter to be controlled, comprising:

a sensing apparatus, said sensing apparatus comprising a power supply, a working electrode and a counter electrode, said working and counter electrodes being substantially unreactive with said slurry; said power supply capable of generating a current through said slurry and between said working and counter electrodes when said electrodes are in contact with said slurry process flow stream; and said sensing apparatus capable of generating a signal representative of said at least one slurry parameter to be controlled based on said electrical current when said electrodes are in contact with said slurry process flow stream;

a parameter control device coupled to said slurry process flow stream;

an automatic electronic control system coupled to said sensing apparatus for receiving said slurry parameter signal, said automatic electronic control system also being coupled to said parameter control device for controlling said slurry parameter.

15. The system of claim 14, wherein said slurry flow stream further comprises abrasive particles dispersed within said slurry flow stream, and wherein said parameter to be controlled is dispersal of said abrasive particles within said slurry flow stream.

16. The system of claim 14 wherein said slurry flow stream further comprises a concentration of oxidant ions dispersed within said slurry flow stream, and wherein said parameter to be controlled is said concentration of oxidant ions within said slurry flow stream.

17. A method of determining dispersal of abrasive particles dispersed within a chemical mechanical polishing slurry based on a comparison of a first current value measured as a function of time with a second current value expressed as a function of time, comprising:

providing at least one working electrode comprised of an electrically conductive material that is substantially unreactive with said slurry;

generating an electrical current between said at least one electrode and said slurry;

measuring said value of said electrical current as a function of time, said value being a first value of current measured as a function of time; and comparing said first value of current measured as a function of time with said second value of current expressed as a function of time to determine said dispersal of said abrasive particles based on said step of comparing.

18. The method of claim 17, wherein said slurry is contained within a chemical mechanical polishing system; and further comprising controlling said dispersal of abrasive particles in said slurry based on said measurement of said electrical current.

19. The method of claim 17, wherein said slurry further comprises a concentration of oxidant ions, and further comprising determining said concentration of said oxidant ions based on said step of comparing.

20. A method of determining and controlling characteristics of a chemical mechanical polishing slurry, comprising the steps of:

providing a chemical mechanical polishing slurry having a concentration of oxidizing ions, said slurry contained within a chemical mechanical polishing system;

providing at least one working electrode comprised of an electrically conductive material that is substantially unreactive with said slurry;

generating an electrical current between said at least one electrode and said slurry;

measuring said electrical current;

determining said concentration of said oxidant ions based on said measurement of said electrical current; and controlling said concentration of said oxidant ions in said slurry based on said measurement of said electrical current.

21. A method of determining and controlling characteristics of a chemical mechanical polishing slurry, comprising the steps of:

providing a chemical mechanical polishing slurry having a concentration of oxidizing ions and having abrasive particles dispersed within said slurry;

providing at least one working electrode comprised of an electrically conductive material that is substantially unreactive with said slurry;

removing either oxidant ions or abrasive particles from said slurry;

generating an electrical current between said at least one electrode and said slurry;

measuring said electrical current; and determining said slurry characteristics based on said measurement of said electrical current.

22. A method of determining dispersal of abrasive particles dispersed within a chemical mechanical polishing slurry, comprising:

providing at least one working electrode comprised of an electrically conductive material that is substantially unreactive with said slurry;

generating an electrical current between said at least one electrode and said slurry;

measuring said electrical current;

determining said dispersal of said abrasive particles based on said measurement of said electrical current; and controlling said dispersal of abrasive particles in said slurry based on said measurement of said electrical current;

wherein said slurry is contained within a chemical mechanical polishing system.

* * * * *